US006275171B1

(12) United States Patent
Waldman et al.

(10) Patent No.: US 6,275,171 B1
(45) Date of Patent: Aug. 14, 2001

(54) RANGEFINDER TYPE NON-IMAGING TRAFFIC SENSOR

(75) Inventors: Gary Waldman; John R. Wootton, both of St. Louis, MO (US)

(73) Assignee: Esco Electronics, Inc., St. Louis, MO (US)

( * ) Notice: Subject to any disclaimer, the term of this patent is extended or adjusted under 35 U.S.C. 154(b) by 0 days.

(21) Appl. No.: 09/302,355

(22) Filed: Apr. 30, 1999

(51) Int. Cl.[7] ..... G08G 1/04

(52) U.S. Cl. ..... 340/942; 340/933; 340/555

(58) Field of Search ..... 340/942, 933, 340/937, 936, 555, 556; 180/167, 169

(56) References Cited

U.S. PATENT DOCUMENTS

| | | | | |
|---|---|---|---|---|
| 3,532,886 | * | 10/1970 | Kruger, Jr. et al. | 340/942 |
| 3,972,021 | * | 7/1976 | Leitz et al. | 340/942 |
| 5,066,950 | * | 11/1991 | Schweitzer et al. | 340/942 |
| 5,101,200 | * | 3/1992 | Swett | 340/942 |
| 5,406,275 | * | 4/1995 | Hassett et al. | 340/933 |
| 5,686,906 | * | 11/1997 | Ono et al. | 340/933 |
| 5,839,085 | * | 11/1998 | Yoshikawa et al. | 340/942 |
| 5,912,634 | * | 6/1999 | Bunnen et al. | 340/933 |
| 5,973,594 | * | 10/1999 | Baldwin et al. | 340/555 |

* cited by examiner

*Primary Examiner*—Daniel J. Wu
*Assistant Examiner*—John Tweel, Jr.
(74) *Attorney, Agent, or Firm*—Polster, Lieder, Woodruff & Lucchesi, L.C.

(57) ABSTRACT

A non-imaging traffic sensing system (10) employs three separate detectors (D1–D3) each positioned above a roadway (R) and spatially separated along the roadway. The detectors detect light reflected off the roadway surface. Each detector has its own field of view (FOV) of the roadway surface and a separate footprint (F1–F3) is defined on the surface by intersection of the respective fields of view with the surface. A disturbance passing over the roadway changes the amount of reflected light sensed by the detectors and the detectors generate respective signals indicative of the amount of reflected light they receive. A first pair of the detectors (D1, D3) measure the speed of a passing disturbance. A second pair of the detectors (D1, D2) identify shadows so to eliminate their effects. The footprints defined by the fields of view of the second detector pair generally overlap. A processor (24) processes signals from the first detector pair to determine the speed of the disturbance. The processor further processes signals from the second detector pair to determine the disturbance's height. The disturbance is classified as vehicular if the height exceeds a predetermined threshold, but as a shadow if less than the threshold. This allows the effects of shadows on the roadway to be readily identified and distinguished from vehicle movement.

24 Claims, 7 Drawing Sheets

RANGEFINDER TYPE NON-IMAGING TRAFFIC SENSOR

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

Introduction

This invention relates to traffic control systems, and more particularly, to a rangefinder type non-imaging traffic sensor used in such a system.

In U.S. Pat. No. 5,764,163, there is described a non-imaging traffic sensor (NITS). As described therein, the sensor design relied upon filtering, both optical and electronic, to discriminate against shadows. While effective in operation, a drawback of a system employing the sensor was the requirement of a luminaire such as a mercury vapor light or lamp to illuminate the roadway monitored by the system. The luminaire illuminated the scene both day and night. The system also severely filters the sensor signal, greatly reducing signal strength. This, in turn, leads to bandwidth restrictions and reduces resolution time to a level far below that of which the sensor is inherently capable. Additionally, the system requires a spectral filter which is the most expensive item in the optics portion of the system.

As described in the patent, the system utilizes a dual sensor geometry (see FIG. 5 of the patent) to measure vehicle velocity. Because of this, an angle exists between the lines-of-sight (LOS) of the two sensors. Such an angle suggests that a rangefinder principle might be used to determine the height (above the pavement) of a passing disturbance. This would render all the filtering and the daytime artificial illumination unnecessary, since shadows have zero height. A number of advantages now result including lower system cost, an increase in the signal-to-noise ratio (SNR), and enhanced time resolution.

Other patents dealing with traffic flow also address shadow removal. See, for example, U.S. Pat. No. 5,467,402. However, the teachings of this '402 patent require a complicated process of shadow removal requiring information to be maintained concerning the season of the year, time of day, and weather condition information, in addition to information concerning shadow length, luminance, etc.

BRIEF SUMMARY OF THE INVENTION

Among the several objects of the invention may be noted the provision of a range finder type, non-imaging sensing system for use in traffic monitoring and roadway control systems;

the provision of such a system to readily detect passage of vehicles over the roadway and to determine the type of vehicle and its speed;

the provision of such a system which is useful with multilane roadways to sense vehicles moving through each lane as well as between lanes;

the provision of such a system which operates under a wide range of climatic conditions to readily identify passing vehicles and does not require artificial light sources to provide sufficient illumination for vehicle sensing;

the provision of such a system which operates equally as effectively in areas where artificial roadway lighting is used;

the provision of such a system to readily identify shadowing effects such as are predominant at sunrise and sunset, the passage of clouds, etc. so to distinguish a passing disturbance as being caused by a vehicle or a shadow and so provide only vehicle information; and, the provision of such a system to be a relatively low cost system which is readily installed above the lanes of a roadway to provide timely and accurate information about traffic on the roadway.

In accordance with the invention, generally stated, a non-imaging traffic sensing system senses vehicular roadway traffic. The system employs three separate detectors each positioned above the roadway and spatially separated along a length of the roadway. The detectors detect light reflected off the roadway surface. Each detector has its own field of view of the roadway surface with a separate footprint being defined on the surface by intersection of the respective fields of view with the surface. Presence of a disturbance passing over the roadway changes the amount of reflected light sensed by the detectors and the detectors generate respective signals indicative of the amount of reflected light they receive. A first pair of the detectors are used for measuring the speed of a passing disturbance. A second pair of the detectors are used to identify shadows so to eliminate their effects. With respect to this second pair of detectors, the footprints are defined by the overlap of their fields of view. A processor processes the detector signals from the first detector pair to determine the speed of the disturbance. The processor further processes the signals from the second detector pair to determine the height of the disturbance. The disturbance is classified as caused by vehicular traffic if the height exceeds a predetermined threshold, but as caused by movement of a shadow if less than the threshold. This allows the effects of shadows on the roadway to be readily identified and distinguished from the movement of vehicular traffic. Other objects and features will be in part apparent and in part pointed out hereinafter.

BRIEF DESCRIPTION OF THE SEVERAL VIEWS OF THE DRAWINGS

In the drawings.

Corresponding reference characters indicate corresponding parts throughout the drawings.

DETAILED DESCRIPTION OF THE INVENTION

Figure 1A:
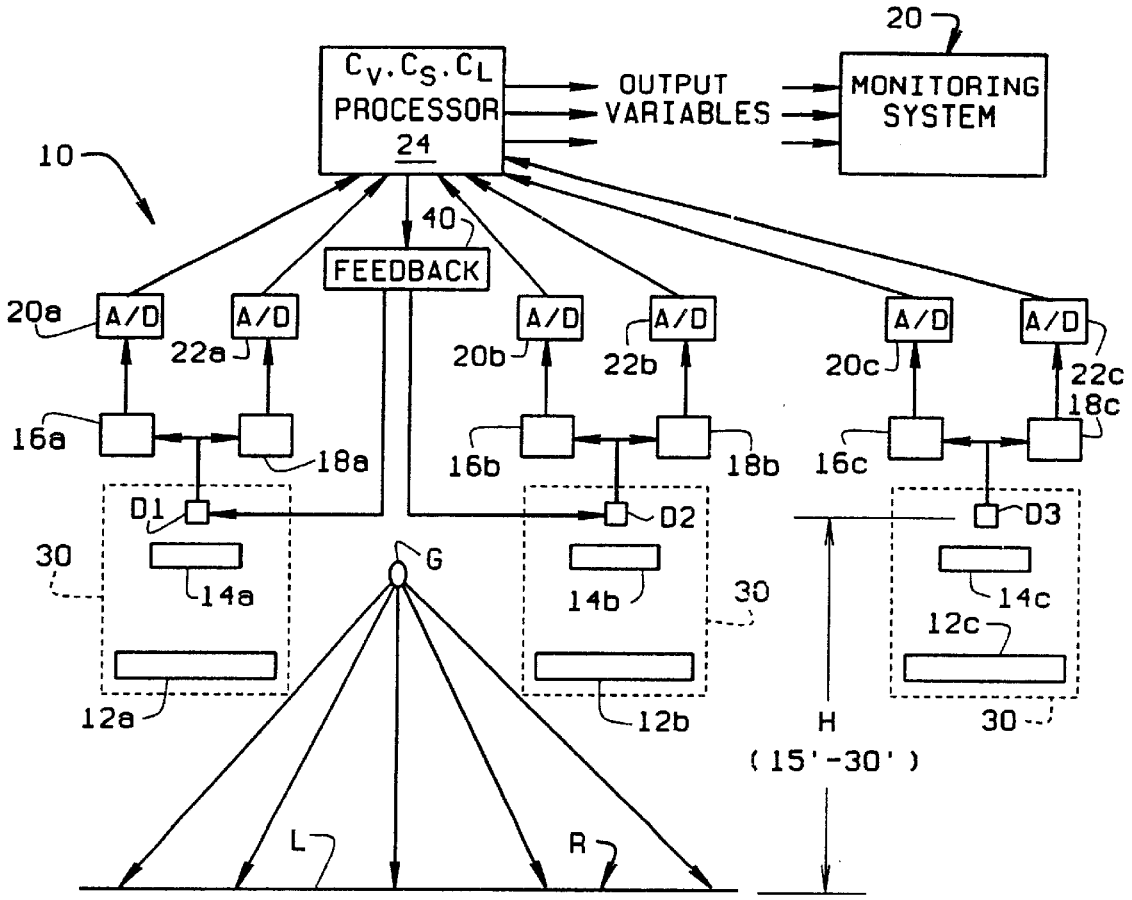
FIG. 1A is a block diagram of a NITS rangefinder system of the present invention and FIG. 1B is a plan view of the roadway and illustrating detector location.
Figure 1B:
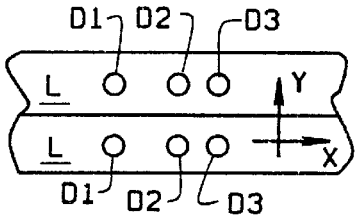

Referring to the drawings, a roadway R is shown in FIGS. 1A and 1B. The roadway is typically a multilane roadway having traffic lanes L over which pass vehicles (not shown) of various sizes and shapes. That is, the vehicles differ in length and width depending upon whether the vehicle is a passenger car, van, truck, etc. While the vehicles may travel in one lane, it is commonplace for vehicles to change lanes as when entering or leaving the roadway, or when passing another vehicle. A NITS rangefinder system 10 of the present invention, as described hereinafter, detects passage of each vehicle past a monitoring location and obtains a variety of useful information about the vehicle. In urban areas, it is commonplace for light sources G (see FIG. 1A) such as mercury vapor lamps to be installed over the roadway and illuminate the traffic lanes at night or at other low light conditions. In rural areas, there are usually no artificial light sources such as the luminaries. It is a feature of the present invention for system 10 to work equally well in either area to detect the passing of vehicles whether during the day, or at night, and under a wide range of atmospheric conditions.

To identify disturbances caused by the passage of shadows, system 10 employs a pair of silicon (Si) photodetectors or photosensors D1 and D2. The sensors are mounted a height H above the roadway so to look downwardly at the roadway. There are a pair of these detectors used for each lane L of traffic, the detectors being spatially separated along the traffic lane as shown in FIGS. 1A and 1B. The detectors are, for example, Burr-Brown OPT-211 monolithic photodiode detectors and amplifier, each unit including a 1 MΩ feedback resistor. Each detector has an associated light collecting optics 12*a,* 12*b,* and light filters 14*a,* 14*b,* interposed between the collecting optics and an input aperture of the detector. An analog signal output of each photodetector is respectively supplied to both a lowpass filter 16*a,* 16*b,* and to a bandpass filter 18*a,* 18*b.* The outputs from the respective filters are provided to analog-to-digital (A/D) converters 20*a,* 20*b,* and 22*a,* 22*b.* The digital signals are then supplied as inputs to a processor 24 which uses the information contained in the signals to determine both that a vehicle (i.e., disturbance) has been detected, and the speed of the vehicle. The information developed by the processor includes the number of vehicles, their individual speeds, the rate at which they are passing the detector location, etc. This data is supplied to a monitoring system 26 which may be for data collection purposes, or as part of a highway management system.

Figure 2:
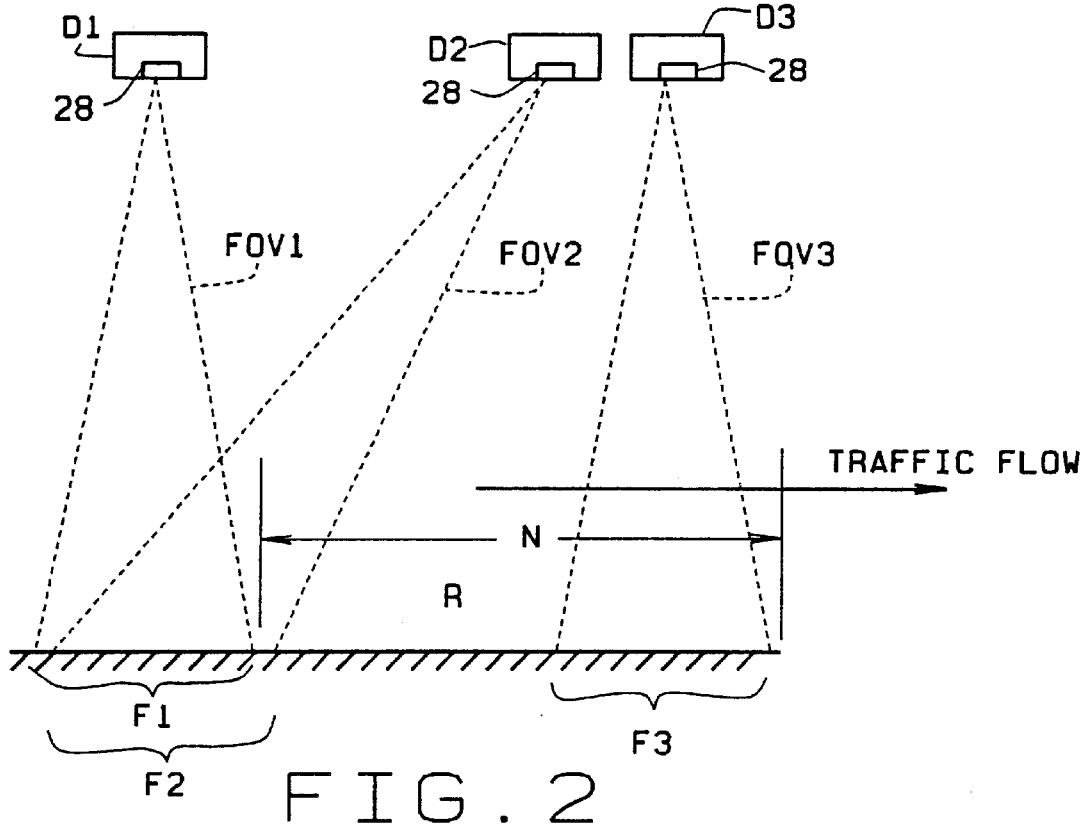
FIG. 2 is a simplified representation of the basic geometry of the system.

FIG. 2 illustrates the basic geometry of a rangefinder NITS system of the present invention. As shown, detectors D1, D2 are positioned above roadway R with each detector having its own field of view FOV comprising a projection from an entrance pupil 28 of that detector toward the pavement. Where each FOV intersects the pavement, a respective footprint F1, F2 is produced. The angle between FOV 1 and FOV 2 is exaggerated for clarity in FIG. 2. Typically this angle is, for example, 4° . 5°, and roadway R is much farther away from the entrance pupils of detectors D1, D2 as compared to their separation. Usually the detectors are mounted 15–30 feet above the roadway, while the separation between the entrance pupil of detectors D1 and D2 is between 1–2 feet.

As shown in FIGS. 1 and 2, a third photodiode detector D3 is incorporated in the system. Detector D3 is identical to the other detectors and the various components associated with this third detector are similarly identified as those associated with the other two detectors. The three detectors extend longitudinally, i.e., lengthwise of the roadway again as shown in FIG. 1B. As described hereinafter, one pair of detectors D1 and D3 are used to measure vehicle velocity, while a second pair of detectors D1 and D2 are used for shadow detection.

Detectors D2 and D3 are positioned as closely together as physically convenient. Each detector and its associated optics comprise a cell (indicated 30 in FIG. 1). The cells of detectors D1 and D3 are identical, as is the cell of detector D2; except for the LOS angle which nominally defines a footprint F2 of this detector generally coincident (or overlapping) with a footprint F1 of detector D1 as shown in FIG. 2.

By monitoring signals from each detector, changes are detected when a disturbance (vehicle, shadow, spot of light) passes through a particular FOV. By setting a threshold on either side of an ambient signal from the detector, a threshold crossing can then be used to start or stop a velocity clock Cv in processor 24. The clock could be started, for example, by a threshold crossing in detector D1 and stopped by a corresponding threshold crossing in detector D3. If the distance N of separation of footprints F1 and F3 is known, the resulting time interval can be used to determine the velocity of the disturbance.

Ideally, footprints F1 and F2 are exactly coincident. In such instance, any shadow or light spot moving along roadway R causes threshold crossings in detectors D1 and D2 at exactly the same time. Now, a clock started by a threshold crossing in detector D1 and stopped by the corresponding crossing in detector D2 is used to discrimate against such disturbances, this clock being referred to as a shadow clock Cs. The time interval recorded by shadow clock Cs provides a measure of the height of the leading edge of the disturbance when that time information is combined with the speed determined from velocity clock Cv. That is; the higher the leading edge, the longer the time interval recorded by shadow clock Cs. In actuality, footprints F1 and F2 are never exactly coincident, so information from velocity clock Cv is required to discriminate against shadows.

A third clock Cl in processor 24 is started by a threshold crossing in detector D1 or D3, and stopped by the next threshold crossing in the same detector. Combined with the velocity information, this third time interval indicates the length of the disturbance for purposes of vehicle classification. It will be understood that it is not necessary to employ three separate clocks; rather, the appropriate information is obtainable by making three separate time intervals measurements all of which are supplied by a single clock.

With no electronic filtering of signals produced by the detectors, a roadway monitoring system works at the full bandwidth of the detectors, e.g., 50 kHz. If the clocks Cv, Cs, and Cl (or the single clock as referred to above), work at the same bandwidth, the system has a 20 $\mu$s time resolution. At a speed of 100 mph (147 ft/s), any disturbance moves only 0.035 in. (0.9 mm) in 20 $\mu$s. With a separation between detectors D1 and D3 of 1 to 2 feet, speed is measured with an accuracy between 0.15% to 0.3%. With a line of sight (LOS) angle between detectors D1 and D2 of 5°, height measurements are made with a resolution of 0.5 in. Such measurement accuracy is sufficient to reliably discriminate against shadows. For example; the system could be programmed so any height measurement of less than 1 foot is disregarded as shadow. These values suggest a 5 kHz system bandwidth (0.2 ms time resolution) is sufficient, since this provides a speed measurement accurate to within 2% with a height resolution of 0.5 in. If a shadow is detected, the detectors' thresholds are adjusted to values corresponding to the shadow filling the footprint so to detect any vehicle in a lane moving inside the shadow cast by a vehicle in an adjacent lane. This situation commonly occurs for low sun conditions, heavy traffic conditions, and with trucks.

Figure 3:
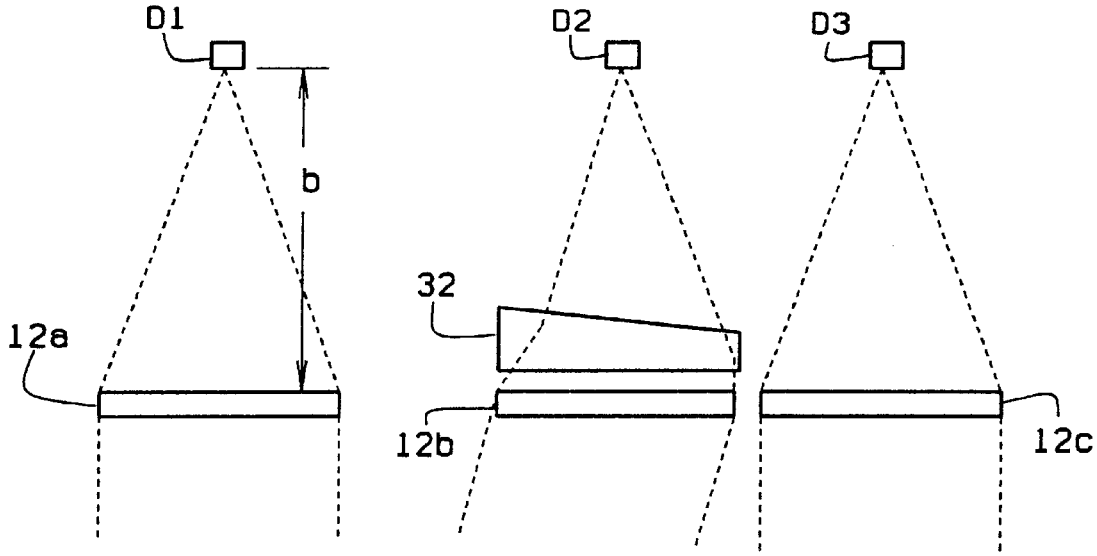
FIG. 3 is a diagram illustrating a first light collecting optics of the system.

Referring to FIG. 3, a simple and relatively inexpensive system is made using the previously referred to basic components such as the Burr-Brown unit, and Fresnel lens collectors 12*a*–12 *c* with 0.85 inch (22 mm) focal lengths and 1.3 inch (33 mm) effective apertures. Three detectors are used for each lane. To deflect the LOS for detector D2 a wedge prism 32 is used. Because the system is a non-imaging system, the distance of the detectors from the collectors (nominally their focal length f) is not critical. Neither is orientation of wedge prism 32 about an axis perpendicular to FIG. 3. The thickness of the wedge (3 mm.) moves the exact focus back about 1 mm in detector D2 and the resultant effect on system operation is negligible. However, lateral positioning of the detectors with respect to their respective collectors axes is critical to the projection of footprints F on the roadway. In calibrating system 10, the angles between the LOS's of detectors D1 and D2, and between detectors D1 and D3 are to be measured exactly. The former angle corresponds to that introduced by wedge prism 32. The latter angle is zero if the three detectors are identically oriented after introduction of prism 32. Any lateral position errors of the detectors, i.e., off-axis, introduces angular displacements which must be measured after the system is assembled. Other measurements to be taken include the separation between centers of the entrance pupils of the detectors, and the height H of the system above the roadway. This latter measurement is made during detector installation. The former is known on the basis of the design geometry of the apertures in the housings (not shown) in which the detectors are installed.

Figure 4:
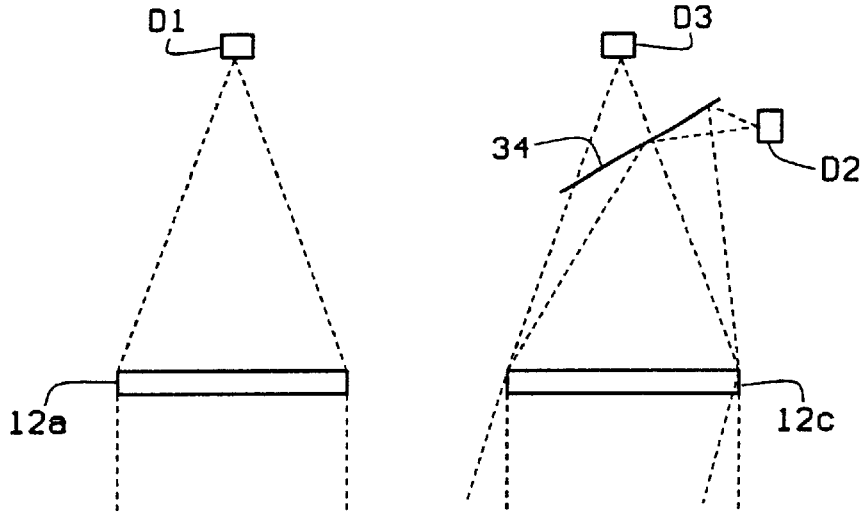
FIG. 4 is a diagram illustrating a second light collecting optics of the system.

Another reasonably cost effective system, is shown in FIG. 4, and has a geometry which lends itself to adjustment of the angle between the LOS's of detectors D1 and D2. This system is useful because misalignment of the footprints F on the roadway for any mounting height is minimized. In FIG. 4, detectors D2 and D3 share a common aperture and collector, and a beamsplitter 34 replaces wedge 32 from the previous embodiment to divert half of the collected radiation to detector D2. The LOS of detector D2 is determined by the angle of beamsplitter 34, while the LOS of detector D3 is unaffected. Now, the angle between the LOS's of detectors D1 and D2 can be adjusted to provide essentially coincident footprints F for any mounting height. Any angular movement of beamsplitter 34 moves the LOS of detector D2 by twice that amount. Since relatively small angles (4° or 5°) are involved, the mechanical motion of the beamsplitter is controlled to approximately 0.1° or better. The setting (lockdown) of the beamsplitter remains fixed over long time periods, this despite the effects of vibrations due to traffic flow or other disturbing influences. A drawback to this approach is there is now an imbalance between the three detectors because detector D1 receives twice as much radiation as the other two detectors, unless the entrance pupils of the detectors are changed. The use of cylindrical collecting optics, as described hereinafter, may alleviate this problem. The cost of this system is comparable to that of the fixed LOS system previously described.

Figure 5:
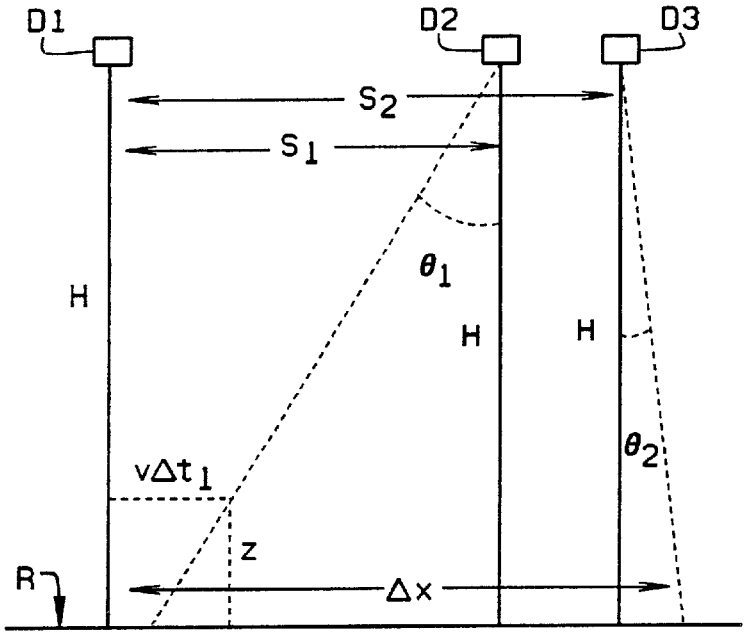
FIG. 5 is an illustration of basic NITS rangefinder geometry.

It is important to know the angle (θ) between the LOS's of detectors D1 and D2 and between the LOS's of detectors D1 and D3, the mounting height H above the roadway, and the separation (S) between the entrance pupils of detectors D1 and D2 and between the entrance pupils of detectors D1 and D3. This is as shown in FIG. 5. An assumption in making these measurements is that a lateral axis of the system is reasonably parallel to roadway R. Another assumption is that the entrance pupil separations are accurately known from machining of the enclosures in which the detectors are housed. Mounting height is measured at installation. The two LOS angles are measured using a calibration procedure which can be carried out before system installation.

In FIG. 5, the LOS of detector D1 is a solid vertical line, while those of detectors D2 and D3 are shown as dashed lines. These latter LOS's make small angles $\theta_1$, $\theta_2$ respectively, with respect to the LOS of detector S1. The first angle $\theta_1$ is close to the wedge 32 deflection angle (i.e., 4°), while angle $\theta_2$is approximately zero. In FIG. 5, the LOS's shown are the center lines of the FOV's; but more precisely, they should be considered as the lines marking the positions of the disturbances in each FOV when the disturbances trigger the respective clocks C in processor 24 as previously discussed.

To calibrate system 10, a sharp-edged disturbance is moved at a known speed, $v_c$, through the system's FOV's at a known distance, $H_c$, from the detectors. The disturbance can be implemented in a variety of ways; for example, a movable belt (not shown) whose width corresponds to that of the footprints, the belt being divided into a white section and a black section with a sharp edge dividing the two sections. Using this belt, the system is calibrated to make the time interval measurements previously described. In the following equations, the shadow clock Cs interval is denoted as $\Delta t_{1c}$, and the velocity clock interval as $\Delta t_{2c}$. Assuming small angles $$\theta_1 \cong \frac{s_1 - v_c \Delta t_{1c}}{H_c} \tag{1}$$

and $$\theta_2 \cong \frac{S_2 - v_c \Delta t_{2c}}{H_c} s/bs^2 - \frac{v_c \Delta t_{2c}}{H_c} \tag{2}$$

In FIG. 5, $\theta_2$ is a negative angle which is acceptable.

When the system is installed at a known height H, disturbance velocities v are determined from a velocity clock reading $\Delta t_2$. Thus, $$v = \frac{\Delta x}{\Delta t_2} = \frac{S_2 - H\theta_2}{\Delta t_2} \tag{3}$$

This numerator is a constant whose value is determined by the calibration measurement of angle $\theta_2$ and the height H measurement. The height z of the leading edge of the disturbance is determined as:

$$z = H - \frac{s_1 - v\Delta t_1}{\theta_1} \tag{4}$$

If the result of equation (4) is below a selected threshold value (e.g., 6 inches), the disturbance is classified as a shadow.

Figure 6:
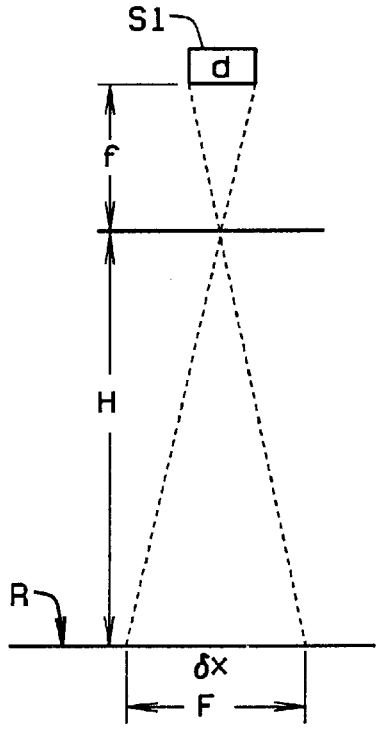
FIG. 6 illustrates footprint formation.

As discussed above with respect to FIG. 2, a footprint F is the projection of a detector D, through its collecting optics, onto roadway R. Detector D1 begins to respond whenever a disturbance enters footprint F1. FIG. 6 illustrates formation of a footprint F, with d being detector size, f collector focal length, and δx footprint size. From the geometry of similar triangles, $$\delta x = \frac{d}{f} H \tag{5}$$

For the detectors and Fresnel lens collectors previously discussed, d=2.29 mm and f=22 mm. For these values, δx≅0.1 H, a rather small footprint size, particularly for the lower mounting heights which might be used. In such installations, mounting height H might be as low as 15 ft, and δx≅1.5 ft squared. This small footprint width may cause problems even if the footprint is exactly centered in a lane L. Standard lane widths are 12 ft. For this, the distance between footprint edges in adjacent lanes is 12 ft–1.5 ft.=10.5 ft. This leaves plenty of room for vehicles straddling lanes to be missed. Even for a mounting height of 25 ft., the resultant straddle width is still 9.5 ft. Conversely, if the footprint is too wide; for example, if it takes up the full 12 ft. lane width, all straddling vehicles would be counted twice. Accordingly, a footprint width of approximately 6 ft. is more practical since such a width makes it unlikely to either miss a vehicle, or to double count it.

While equation (5) implies that a shorter focal length f will produce a larger footprint F at any mounting height H, and even though shorter focal length lenses are available, there are problems with a system using focal lengths which are too short. First, the LOS angles are sensitive to the lateral placement of detectors D with respect to the axes of their collector optics 12. For example, a displacement of 1 mm produces an angular LOS displacement of 1/22 rad, or 2.6°. Decreasing focal length f makes this angular displacement worse. Second, increasing footprint areas makes system 10 less sensitive to vehicles moving "off-center", i.e., not filling a FOV. This, in turn, suggests that rectangular footprints with a long dimension extending laterally of a lane L may be better than square footprints. In such a footprint configuration, the dimension extending along the lane may be shrunken so to keep the footprint area small. Masking a detector to reduce its sensing capability in one dimension, while decreasing focal length f would solve this second problem but not the first.

Figure 7:
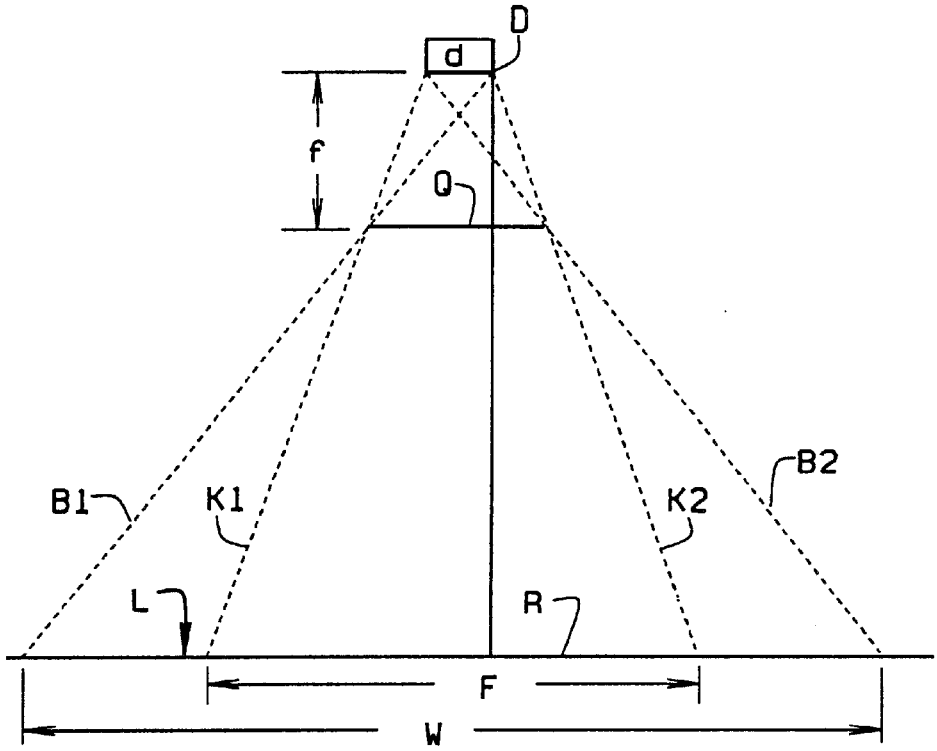
FIG. 7 illustrates cross-lane footprint formation.

A better solution is use of a cylindrical lens which focuses on the longitudinal lane axis and which has a longer focal length. A drawback to this approach is that cylindrical lens collectors significantly increase system cost. Even the lowest cost cylindrical lenses are double the cost of the Fresnel lenses previously discussed for use in the collector optics of the photodiode detectors. Since three collectors are required for each lane, use of the cylindrical lenses at least doubles system cost Referring now to FIG. 7, any point on roadway R outside the dashed lines B1 and B2 cannot be seen by a detector D, and are therefore outside footprint F and cannot contribute radiation to any signal obtained by the detector. Any point on the roadway between dashed lines B1 and B2 and the dotted lines K1 and K2 is seen by a detector and contributes radiation to that detector according to whether such point is closer to the inside or outside of the region. Any point on the pavement inside dotted lines K1 and K2 contributes the same amount of radiation to the signal, and such point is fully within footprint F. The result of all this is vignetting within a cross-lane FOV, and a soft-edged footprint producing a full response within the dotted lines but falling (linearly) to a zero response at the dashed lines.

For a footprint W defined by dashed lines B1, B2, if a perpendicular is dropped to roadway R from either edge of detector D, it will form (with a dashed line B1 or B2 and the roadway) a right triangle whose base is W/2+d/2, where d is the width of the detector aperture.

$$\frac{W+d}{2} = (H+f)\tan\theta \tag{6}$$

where θ is the angle between the perpendicular and the appropriate dashed line. A smaller right triangle is also formed by the same perpendicular, the same dashed line, and the detector aperture, $$\frac{Q+d}{2} = f\tan\theta \tag{7}$$

Dividing equation (6) by equation (7) gives $$\frac{W+d}{Q+d} = \frac{H+f}{f} \tag{8}$$

So, $$W = \frac{H+f}{f}(Q+d) - d \quad \text{and,} \quad W \cong \frac{H}{f}(Q+d) \tag{9}$$

For the approximation of equation (9), it is assumed that the focal length f (approximately 1 to 2 inches) is small compared to the height H of detector D above the roadway (greater than 10 ft), and that the aperture (2.29 mm) is small compared to footprint W (which is usually ft. in length). Equation (10) gives the width of footprint W for a given mounting height and focal length, as a function of aperture stop width.

The same perpendicular, together with one of the dotted lines K1, K2 and the roadway, provides an expression for the inner width w, $$\frac{w-d}{Q-d} = \frac{H+f}{f} \text{ and } w \cong \frac{H}{f}(Q-d) \tag{10}$$

Cylindrical lenses are available with a focal length f=22.2 mm, a length (non-focusing dimension) of 60 mm, and a width of 12.7 mm. With this lens, Q can have any value from 50 mm downward. For a detector D height 15 feet above the roadway (H=15 ft), the following footprint size table is constructed:

TABLE 1

| Cross-Lane Footprint Widths | | |
|---|---|---|
| Q (mm) | w (ft) | W (ft) |
| 4 | 1.16 | 4.25 |
| 5 | 1.83 | 4.93 |
| 6 | 2.51 | 5.60 |
| 7 | 3.18 | 6.28 |
| 8 | 3.86 | 6.95 |
| 9 | 4.53 | 7.63 |
| 10 | 5.21 | 8.30 |
| 15 | 8.59 | 11.68 |

For higher detector mounting heights, the table values increase linearly. For the 15 ft mounting height, the optimum aperture has as a range of 6–10 mm.

With respect to signal magnitude and signal-to-noise ratio (SNR) for a detector D having standard optics 12, irradiance E of the detector is given by $$E = E_s \frac{\rho \tau Q^2}{4f^2} \tag{11}$$

where

Es≡scene ambient irradiance

ρ≡scene reflectance

τ≡optics transmittance

For aged concrete, ρ≅0.27. Also, the optics transmittance is assumed to be unity, τ≅1. With Fresnel lenses, f≅22 mm, and aperture Q may be 33 mm., the effective aperture of the lens itself. The highest value of radiance E occurs when the sun is high in the sky. Ideally, solar spectral irradiance time is integrated with spectral response of the detector. For simplicity, only solar irradiance within the passband (400–1100 mm) of the detector is considered. Solar irradiance values vary from about 730 W/m$^2$ (when the sun is directly overhead) to approximately 345 W/m$^2$ (when the sum is low, e.g., a 78.5° solar zenith angle)[1]. Except in tropical latitudes, the sum is never directly overhead, so a maximum value of 600 W/m$^2$ can be used. Using these values, a Table 2 is constructed as:

TABLE 2

| Maximum Detector Irradiance Values | |
|---|---|
| Q (mm) | E (W/m$^2$) |
| 5 | 2.09 |
| 10 | 8.37 |
| 15 | 18.83 |
| 20 | 33.47 |
| 25 | 52.30 |
| 30 | 75.31 |

Figure 8:
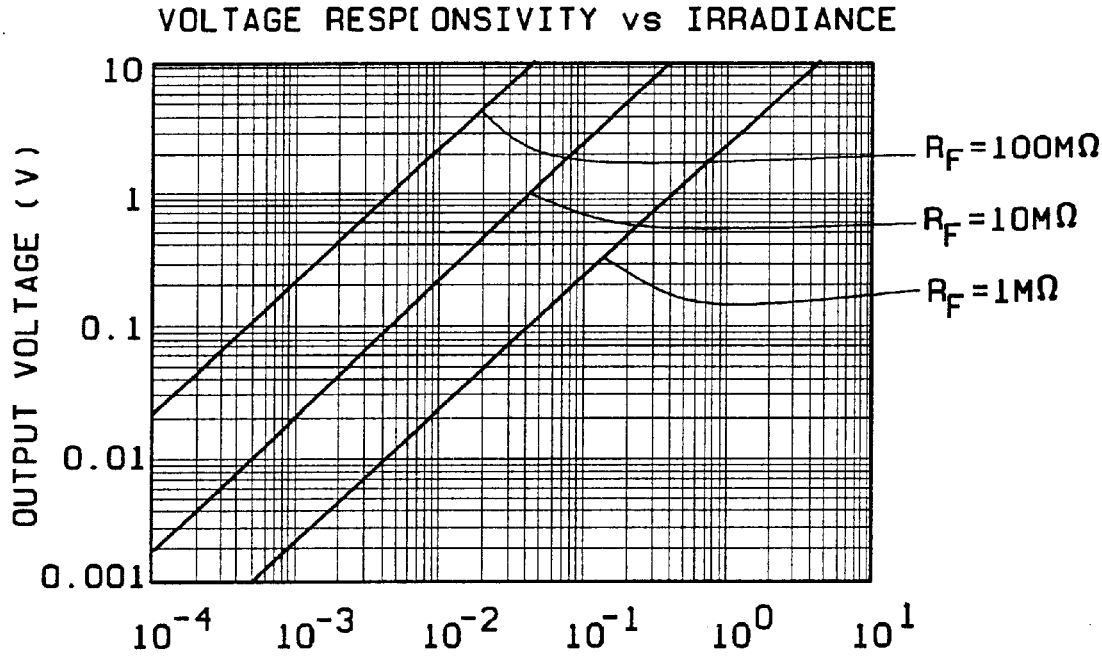
FIG. 8 is a graph of voltage responsivity vs. irradiance for a detector used in the system.

The response of a detector D is shown in FIG. 8. From the Figs. it is seen that an aperture diameter of 10 mm results in saturation (with a 1 MΩ feedback resistor); so a 5 mm aperture is preferable. Noise effective power (NEP) curves (not shown) for the detector indicate a SNR of approximately $10^4$. Accordingly, system 10 should detect changes of one part in 100. At maximum light levels, the system can operate with an aperture between 5 and 10 mm in diameter (stepping down the available aperture on the Fresnel lenses) with a 1 MΩ feedback resistance; or, with a larger aperture and a smaller feedback resistance.

[1]P. R. Gast—"Thermal Radiation"—in *Handbook of Geophysics* (McMillan Co., New York, 1961)

Figure 9:
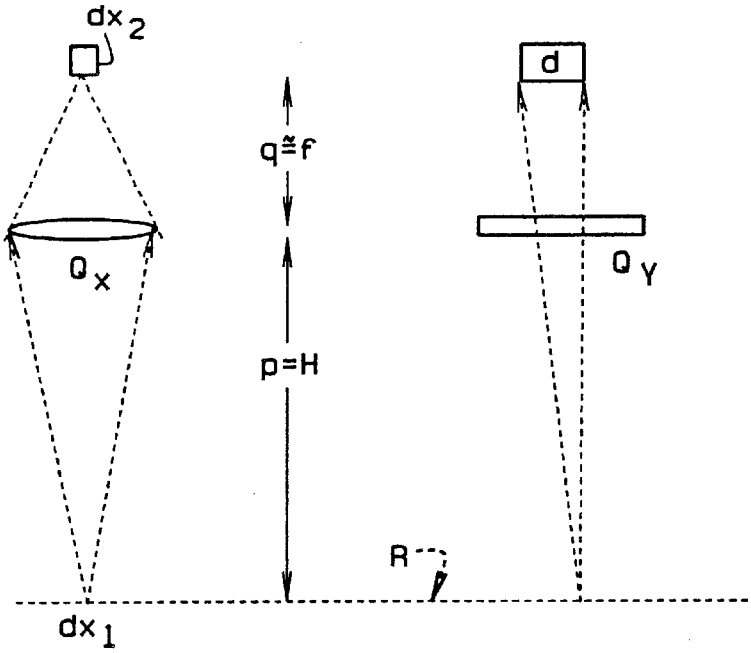
FIG. 9 illustrates the geometry involved using cylindrical light collecting optics in the system.

Referring to FIG. 9, radiant flux incident on a detector D is shown from an element $dx_1$ of area at roadway R, both in the longitudinal axis (the x-axis) of the lane and in the orthogonal, non-focusing axis (the y-axis) of the lane. See FIG. 1B. This radiant flux is given by $$dF = L\tau\Delta\omega dA_1 \tag{12}$$

where

L≡radiance from pavement

τ≡optics transmittance

Δω≡solid angle of radiation cone which strikes the detector dA1=element of source (roadway area)

Radiance from Roadway R, assuming it is a Lambertian reflector, is $$L = \frac{\rho E_s}{\pi} \tag{13}$$

A solid angle is given by the area of the radiation cone at an entrance pupil 28 of the detector, divided by the height p from the roadway to the pupil as follows:

$$\Delta\omega \cong \frac{Q_x d}{p^2} \tag{14}$$

The basis of equation (14) is that radiation across the whole x-dimension of the entrance pupil 28 is focused down to the image line, but that only the radiation angle subtended by the detector dimension impinges upon the pupil in its -dimension. The equation is further based upon an approximation that the latter angle has a spread of d at the distance p; whereas, this is only true for the distance p+f≅p, as shown in FIG. 9. The source area $dA_1$ in Equation (14) is a strip on roadway R as wide as the footprint w calculated in accordance with Equation (10). This neglects any contribution from the vignetted region between the dashed lines B1, B2, and the dotted lines K1, K2, of FIG. 7, but the contribution of those regions is relatively negligible. For a corresponding image area $dA_2$, a strip is taken across the whole of detector D. Using Equation (10), $$dA_1 = w dx_1 = \frac{Q_y - d}{f} H dx_1 \tag{15}$$

and $$dA_2 = d\, dx_2 \tag{16}$$

The irradiance E of detector S is the flux per unit area. This means $$E \equiv \frac{dF}{dA_2} = \frac{\rho E_s \tau}{\pi} \frac{Q_x d}{p^2} \frac{Q_y - d}{f} \frac{H}{d} \frac{dx_1}{dx_2} \tag{17}$$

From FIG. 9, since p=H, and q=f, $dx_1/dx_2$=p/q. Combining this into Equation 17 gives $$E = E_s \rho \tau \frac{Q_x (Q_y - d)}{\pi f^2} \tag{18}$$

From the previous discussion relating to cylindrical lenses, values pertaining to the cylindrical lens described can be used with equation (18). The lens could be masked down to 10*10 mm to approximate the desired cross-lane footprint width since one advantage of cylindrical lenses is that the two dimensions may be masked down independently to different values to adjust both footprint width and detector irradiance. Then, using the reflectance value previously obtained, $E \cong 0.014\ E_s$. This value is appropriate for maximum scene irradiance to produce near-saturation. If the shared aperture arrangement for detectors D2 and D3 is utilized, then that aperture must be twice as large in the x-dimension to gather as much radiation for the two detectors as for the single detector D1.

With the foregoing, neither the detector signal nor its SNR present any problems with maximum illumination (full sunlight) conditions. Reasonably sized apertures with moderate cost optics (either circular or cylindrical) provide a near-saturation output from a detector. As used herein, near-saturation means input irradiance values in the range of 1–10 $W/m^2$, and output voltage values of 1–10 V. Since only ambient lighting is relied upon, particularly in rural installations, then a wide range of input irradiance values must be taken into account. For example, scene illuminance values can range from 100,000 lux under full sunlight conditions down to 0.001 lux with a clear, moonless night sky. And, while illuminance refers here only to the visible spectrum, there are similar variations in irradiance values within the detector passband. As the above values indicate, there is a range of eight orders of magnitude over which the system must operate, while needing to detect small changes in a signal (a few %) for passing vehicles. However, as the response curves of FIG. 8 indicate, the most that can reasonably be expected from a detector D is about 4 decades, since the top of the graph represents saturation, and the bottom of the graph represents a noise floor (SNR=1). This range, by itself, only allows the system to operate from full sunlight to twilight Furthermore, if the A/D conversion performed as part of the signal processing only has an eight bit capability, then only 256 signal levels can be accommodated; effectively not allowing variations at the lower end of the detector range to be recognized.

Dynamic range problems with system 10 can be solved by:

1. Artificial lighting;
2. Variable entrance pupil;
3. Automatic gain control (AGC), or by any combination of the three.

With respect to artificial lighting, it is unlikely the system will operate over an eight order range of natural lighting in urban settings. Rather, there exists a recommended average maintained illuminance level for urban freeways[2] of 6–8 lux. If this standard is met in the urban areas where system 10 is used, then the system need operate over a little more than four orders of magnitude, which is acceptable. Even so, SNR and quantization problems remain at the lower end of the system's operating range.

[2]R. E. Stark—"Roadway Lighting"—in *Traffic Engineering Handbook, J. L. Pline, ed,* (Prentice-Hall, Englewood Cliffs, 1992) p. 320

With respect to a variable entrance pupil 28 of a detector D, system 10 can employ an iris which moves to change the size of the entrance pupil as a function of the signal from the detector. A feedback control 40 (see FIG. 1A) using, for example, small electric motors would accomplish this, but adds complexity to the system since two or three detectors (each having its own pupil control) are required for each lane L, and because of the wide range of atmospheric conditions in which the system must operate. If the system uses circular optics like the Fresnel lenses previously discussed, then a circular iris is used. Now feedback control 40 could function with a variable slit (in the x-axis of the lane). With respect to the various lenses, cylindrical lenses are only available in x size of 12.7 mm. which does not provide much increase in for a 5 to 10 mm. opening in this dimension. Large cylindrical lenses, while available, have longer focal lengths and are more costly. Fresnel lenses, however, have more available aperture than the 5 to 10 mm. dimension used in the above calculations. For example, a full aperture of 33 mm would provide another order of magnitude for the collecting optics.

Figure 10A:
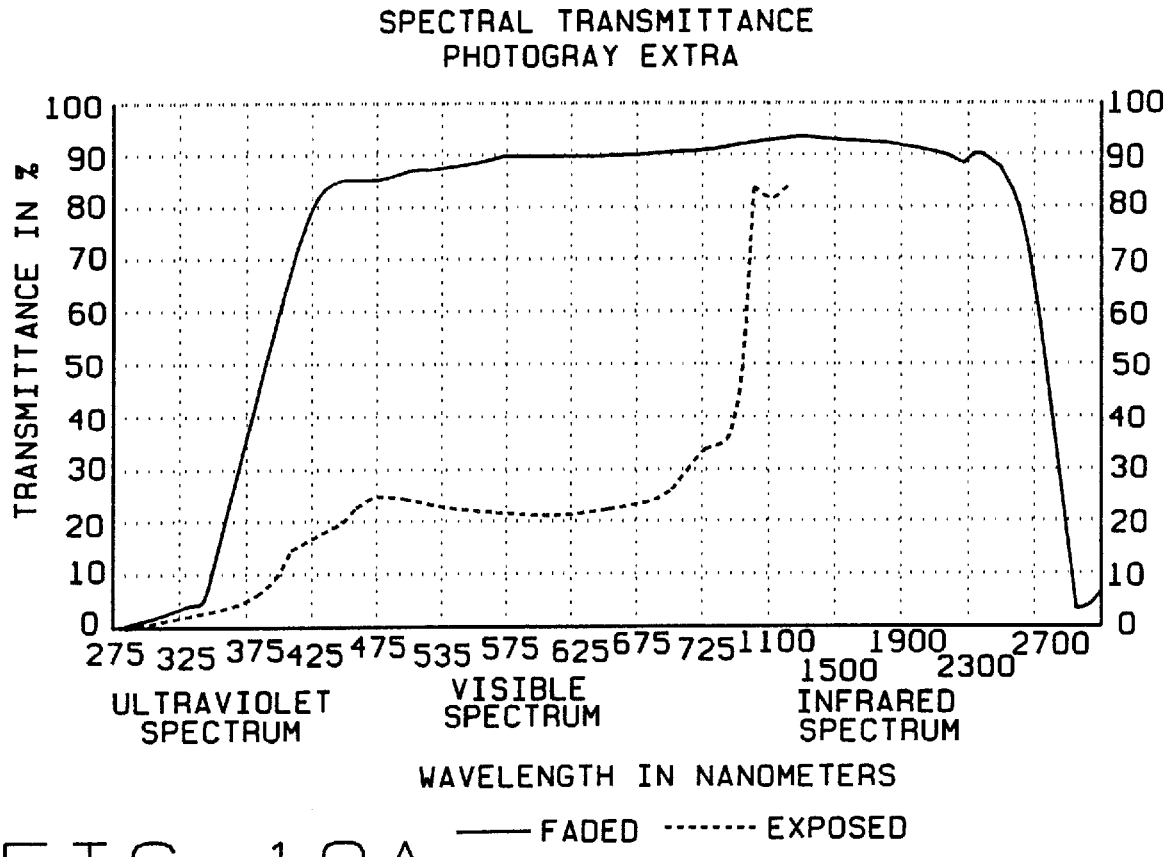
FIGS. 10–10C are graphs illustrating the spectral transmission properties of various type of glass.
Figure 10B:
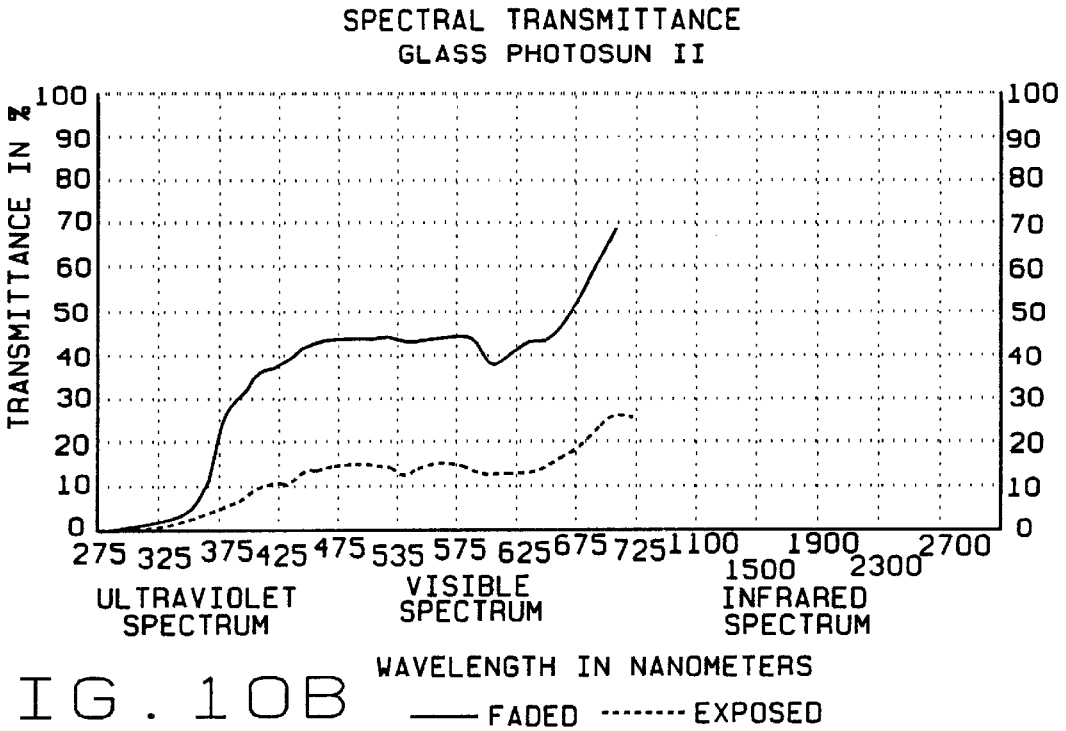
Figure 10C:
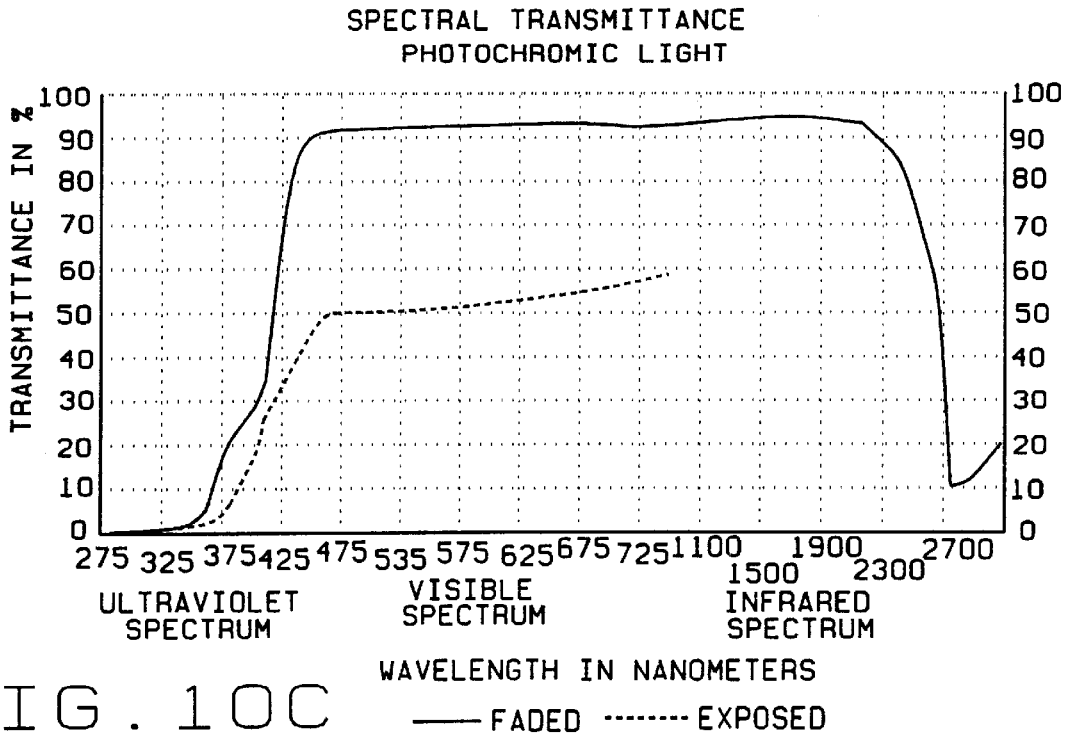

Another way of providing a variable aperture is to change the transmission factor $\tau$, which, as used in equations (11) and (18) was set to unity. For example, a photochromic glass window can be used which automatically darkens in bright light, has the advantage of no moving parts, and is cheaper than the variable iris approach discussed above. A factor of 2× to 4× in light transmission is obtained using these windows, as shown in the performance chart of FIG. 10A. Similar results are obtained with other types of glass as shown in FIGS. 10B and 10C.

Figure 11:
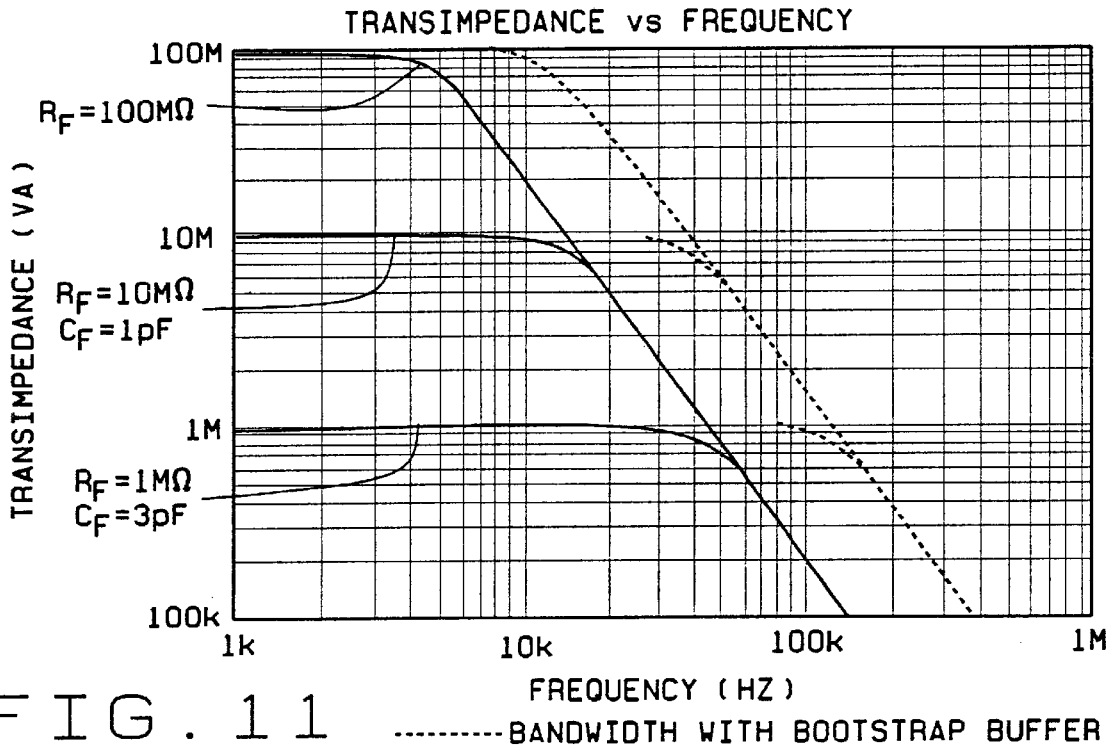
FIG. 11 is a chart of transimpedance vs. frequency for different resistor values; and, FIG. 12 is a chart of net effective power vs. measurement bandwidth.

With respect to AGC, as shown FIG. 8, one way to accomplish AGC is to automatically switch feedback resistance from 1 MΩ to 10 MΩ to 100 MΩ as the input signal to a detector D decreases, thus keeping output voltage in the range of 0.1–10 V., while input irradiance varies over 4 orders of magnitude. This range of resistance change has bandwidth consequences as shown in the transimpedance curves of FIG. 11. But as noted above, system 10 can operate successfully at a 5 kHz bandwidth, which bandwidth is achievable even at a feedback resistance of 100 MΩ. In operation, the feedback resistance is automatically changed as a function of signal strength. Alternatively, a separate AGC circuit can be employed which automatically amplifies the signal from a detector D to an acceptable level for A/D conversion.

Figure 12:
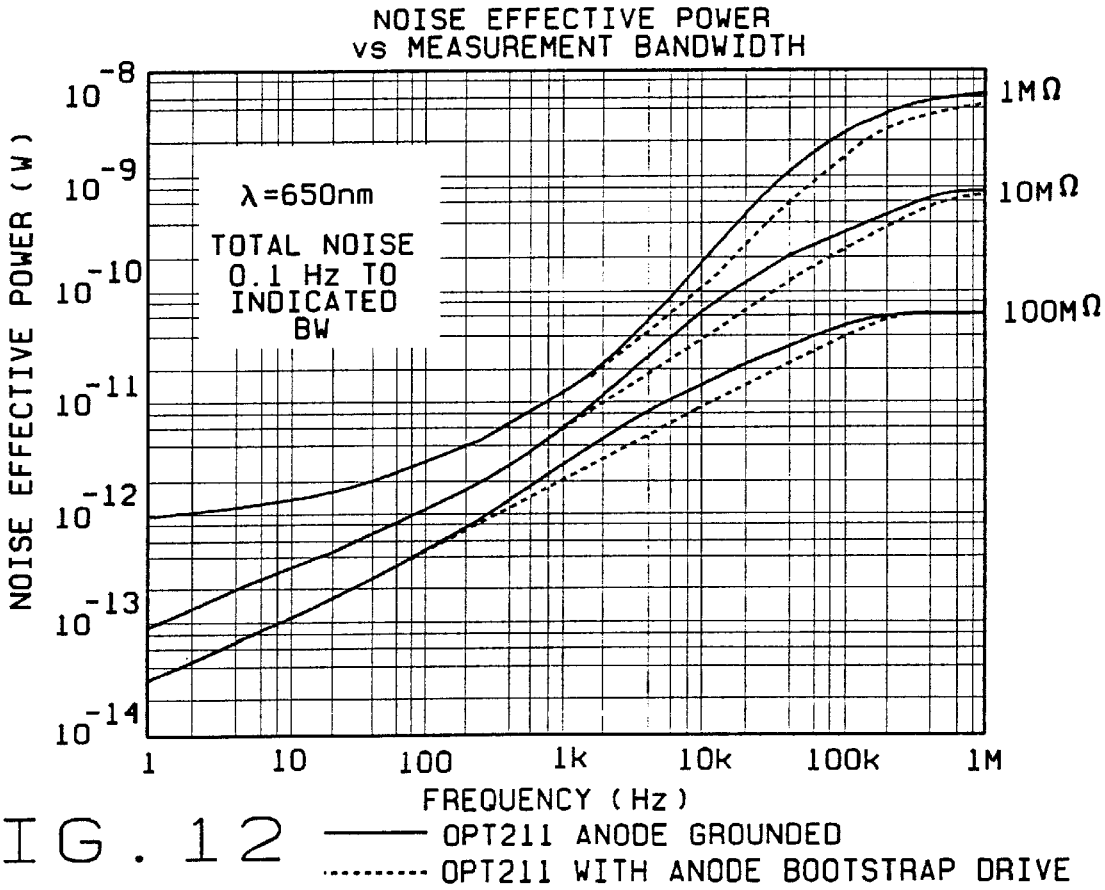

Finally, with respect to SNR, system 10 as noted, is expected to operate over a wide range of illuminance values. It is also assumed that the effective irradiance (within a detector D's spectral passband) varies over a range of approximately 16,666 to 1. It is further assumed that entrance pupil 28 has been designed to have a near saturation value of 5 $W/m^2$ (for a 1 MΩ feedback resistance) for the maximum irradiance value. These assumptions place the minimum effective irradiance at about 0.0003 $W/m^2$ (i.e., 5/16,666). For the 2.29×2.29 mm. detector area, total power is 1.57 nW. Using the 1 MΩ curve from the noise effective power chart in FIG. 12, net effective power (NEP)≅1 nW at 50 kHz. Thus, a SNR≅1.57, can be expected. This implies that reliably detecting a small change, with a low false alarm rate, is difficult at the lowest light levels, even if dynamic range is provided by subsequent amplification. However, an AGC procedure of increasing feedback resistance as the signal decreases resolves this problem; because, as shown in FIG. 12, system 10 will operate on the 100 MΩ curve at the lowest input to a detector. Using that curve, NEP≅0.03 nW and SNR≅52, which is viable for proper system operation.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

What is claimed is:

1. A non-imaging traffic sensing system for sensing vehicular traffic passing over a roadway without the use of artificial illumination comprising:

first and second pairs of light detectors positioned above said roadway and spatially separated along a length of the roadway, said detectors detecting light reflected off a surface of the roadway, each detector having its own field of view of the roadway surface with a separate footprint being defined on said surface by intersection of the respective fields of view with said surface, presence of a disturbance passing over the roadway changing the amount of reflected light sensed by said detectors and said detectors generating respective signals indicative of the amount of reflected light they receive;

said first pair of detectors being used to measure the speed of said disturbance;

said second pair of detectors being used to identify the passage of shadows over the roadway so to eliminate shadow effects, the footprints defined by the fields of view of said second pair of detectors generally overlapping, said first and second pairs of detectors being comprised of three light detectors positioned above the roadway and mounted lengthwise of said roadway in a linear arrangement, one of said detectors being common to each pair of detectors and said first pair of detectors being comprised by the detectors at each end of the arrangement; and, a processor processing signals from said first pair of detectors to determine the speed of the disturbance, and said processor further processing signals from said second pair of detectors to determine the height of the disturbance, the disturbance being classified as vehicular traffic if the height exceeds a predetermined threshold, but as caused by movement of a shadow if less than the threshold, whereby disturbances caused by the effects of shadows on the roadway are readily identified and distinguished from disturbances caused by the movement of vehicular traffic.

2. A non-imaging traffic sensing system for distinguishing between the movement of vehicular traffic and shadows over a roadway under a variety of weather conditions and without the use of artificial illumination comprising:

first and second light detectors positioned above said roadway and spatially separated along a length of the roadway, the detectors detecting light reflected off a surface of said roadway with each detector having its own field of view of said roadway surface, a separate footprint being defined on said surface by intersection of the respective fields of view with said surface, the footprints defined by said fields of view generally overlapping, and presence of a disturbance passing over said roadway changing the amount of reflected light sensed by said detectors with said detectors generating respective signals indicative of the amount of reflected light sensed thereby;

a third light detector is used with one of the other said detectors to measure the speed of said disturbance, said detectors extending lengthwise of said roadway in a linear arrangement with said second detector positioned intermediate said first and third detectors; and, a processor processing said signals from said detectors to determine if said disturbance is caused by passage of a shadow or vehicular traffic, said processor processing said signals to determine the height of said disturbance with said disturbance being classified as vehicular traffic if the height exceeds a predetermined threshold, but as caused by a shadow if less than said threshold, whereby the effects of shadows on the roadway are readily identified and distinguished from the movement of vehicular traffic.

3. The system of claim 2 wherein said light collecting optics includes a cylindrical lens focused on a longitudinal axis of said roadway.

4. A non-imaging traffic sensing system for sensing vehicular traffic passing over a roadway without the use of artificial illumination comprising:

first and second pairs of light detectors positioned above said roadway and spatially separated along a length of the roadway, said detectors detecting light reflected off a surface of the roadway, each detector having its own field of view of the roadway surface with a separate footprint being defined on said surface by intersection of the respective fields of view with said surface, presence of a disturbance passing over the roadway changing the amount of reflected light sensed by said detectors and said detectors generating respective signals indicative of the amount of reflected light they receive;

said first pair of detectors being used to measure the speed of said disturbance;

said second pair of detectors being used to identify the passage of shadows over the roadway so to eliminate shadow effects, the footprints defined by the fields of view of said second pair of detectors generally overlapping, said two pair of detectors comprising a total of three light detectors with one of said detectors being common to each of said first and second pair of detectors, and said detectors being mounted lengthwise of said roadway in a linear arrangement with said first pair of detectors comprising the detectors at each end of the arrangement and said second pair of detectors by one of the end detectors and the middle detector in the arrangement; and, a processor processing signals from said first pair of detectors to determine the speed of the disturbance, and said processor further processing signals from said second pair of detectors to determine the height of the disturbance, the disturbance being classified as vehicular traffic if the height exceeds a predetermined threshold, but as caused by movement of a shadow if less than the threshold, whereby disturbances caused by the effects of shadows on the roadway are readily identified and distinguished from disturbances caused by the movement of vehicular traffic.

5. A non-imaging traffic sensing system for sensing vehicular traffic passing over a roadway without the use of artificial illumination comprising:

first and second pairs of light detectors positioned above said roadway and spatially separated along a length of the roadway, said pairs of detectors comprising a total of three light detectors with one of said detectors being common to each pair, said detectors being mounted lengthwise of said roadway in a linear arrangement with said first pair of detectors comprising the detectors at each end of the arrangement and said second pair of detectors comprising one of the end detectors and the middle detector in the arrangement, said detectors each detecting light reflected off a surface of the roadway and having its own field of view of the roadway surface with a separate footprint being defined on said surface by intersection of the respective fields of view with said surface, presence of a vehicle passing over the roadway changing the amount of reflected light sensed by said detectors and said detectors generating respective signals indicative of the amount of reflected light they receive; and, a processor processing signals from said first pair of detectors to determine the speed of the vehicle and signals from said second pair of detectors to determine the height of the vehicle with the vehicle being classified as such only if the height exceeds a predetermined threshold.

6. The system of claim 4 wherein each detector receives light having an illuminance value ranging from approximately 0.001 lux to approximately 100,000 lux.

7. The system of claim 6 further including light collecting optics for each detector for collecting light reflected from said roadway surface.

8. The system of claim 7 further including a light filter interposed between said light collecting optics and its associated detector.

9. The system of claim 7 further including conversion means for converting an output signal from a detector, a converted signal from said conversion means being supplied as an input to said processor.

10. The system of claim 9 wherein said conversion means performs an analog-to-digital conversion on said detector output signal.

11. The system of claim 10 further including filter means for filtering said detector output signal.

12. The system of claim 11 wherein said filter means includes a low pass filter and a bandpass filter and said detector output signal is separately applied to each filter.

13. The system of claim 12 wherein a filtered detector output signal from each of said filters is supplied to said conversion means.

14. The system of claim 7 wherein said light collecting optics includes a Fresnel lens.

15. The system of claim 7 wherein said light collecting optics includes a cylindrical lens focused on a longitudinal axis of said roadway.

16. The system of claim 15 wherein said light collecting optics for a detector of said second pair of detectors includes a wedge prism lens.

17. The system of claim 15 wherein a detector of said first pair of detectors and a detector of said second thereof have a common aperture and said light collecting optics includes a beamsplitter for dividing collected light between the two detectors.

18. The system of claim 2 wherein each detector receives light having an illuminance value ranging from approximately 0.001 lux to approximately 100,000 lux.

19. The system of claim 18 further including light collecting optics for each detector for collecting light reflected from said roadway surface.

20. The system of claim 19 further including a light filter interposed between said light collecting optics and its associated detector.

21. The method of claim 20 wherein said light collecting optics includes a Fresnel lens.

22. Non-imaging apparatus for sensing passage of a disturbance over a light reflective surface to determine if said disturbance is caused by passage of a physical object or by a shadow, comprising:

first and second pairs of light detectors spaced from said surface and spatially separated from each other along a dimension of said surface, said detectors detecting light reflected off said surface with each detector having its own field of view of said surface, a separate footprint being defined on said surface by intersection of the respective fields of view with said surface, the footprints defined by said overlap of the fields of view, and passage of a disturbance over said surface changing the amount of reflected light sensed by said detectors with said pairs of detectors generating signals indicative of the amount of reflected light received thereby, said two pair of detectors comprising a total of three light detectors with one of said detectors being common to each of said first and second pair of detectors, and said detectors being mounted lengthwise of said roadway in a linear arrangement with said first pair of detectors comprising the detectors at each end of the arrangement and said second pair of detectors by one of the end detectors and the middle detector in the arrangement; and, a processor processing said signals to determine if said disturbance is caused by passage of an object or a shadow over said surface, said processor processing said detector signals to determine the height of said disturbance, said disturbance being classified as an object if the height exceeds a predetermined threshold, but as a shadow if less than said threshold, whereby the effects of shadows on said surface are readily identified and distinguished from passage of an object.

23. The system of claim 22 wherein said light collecting optics for said second detector includes a wedge prism lens.

24. The system of claim 22 wherein said second and third detectors have a common aperture and said light collecting optics includes a beamsplitter for dividing collected light between the two detectors.

* * * * *

UNITED STATES PATENT AND TRADEMARK OFFICE

CERTIFICATE OF CORRECTION

PATENT NO. : 6,275,171 B1
DATED : August 14, 2001
INVENTOR(S) : Waldman et al.

It is certified that error appears in the above-identified patent and that said Letters Patent is hereby corrected as shown below:

Column 3,
Line 64, replace "4°.5°" with -- "4°-5°" --

Column 10,
Line 34, before "-" insert -- y --
Line 63 (equation (18)), replace "$E = E_s \rho\tau \frac{Q_x (Q_y - d)}{\pi f^2}$" with
-- $E = E_s \frac{\rho\tau Q_x (Q_y - d)}{\pi f^2}$ --

Signed and Sealed this

Twelfth Day of March, 2002

*Attest:*

*Attesting Officer*

JAMES E. ROGAN
*Director of the United States Patent and Trademark Office*